United States Patent [19]

Owen

[11] 4,013,217

[45] Mar. 22, 1977

[54] DOUBLE INDUCTION AIR CONDITIONING WITH FLUIDIC CONTROL

[75] Inventor: Edward A. Owen, Penn Hills Township, Pa.

[73] Assignee: Westinghouse Electric Corporation, Pittsburgh, Pa.

[22] Filed: Oct. 31, 1975

[21] Appl. No.: 627,733

[52] U.S. Cl. ..... 236/13; 236/80 D; 137/604; 98/38 E

[51] Int. Cl.[2] ..... F24F 13/04

[58] Field of Search ..... 236/49, 80 D, 79, 13; 137/805, 840, 604; 417/151, 179, 187; 98/38 E

[56] References Cited

UNITED STATES PATENTS

| | | | |
|---|---|---|---|
| 694,002 | 2/1902 | Davis | 417/151 |
| 3,230,972 | 1/1966 | Davis, Jr. | 137/604 |
| 3,390,720 | 7/1968 | Meckler | 236/13 X |
| 3,853,173 | 12/1974 | Osheroff | 165/35 |

*Primary Examiner*—William E. Wayner
*Attorney, Agent, or Firm*—E. C. Arenz

[57] ABSTRACT

A double induction mixing box is provided with damperless openings to each of two opposite side passages in the box and fluidic diverter means between a primary air supply to the box and the opposite side passages is used for controlling the diversion of primary air between the opposite side passages to correspondingly control the proportioning of the induction of air into the two damperless openings from a room air source and from a ceiling plenum air source.

4 Claims, 3 Drawing Figures

DOUBLE INDUCTION AIR CONDITIONING WITH FLUIDIC CONTROL

BACKGROUND OF THE INVENTION

1. Field of the Invention

The invention pertains to the art of air conditioning with induction units of the type in which a primary air flow induces a secondary air flow into a mixing chamber from which conditioned air is discharged to the space served.

2. Description of the Prior Art

Double induction systems for air conditioning are disclosed in U.S. Reissue Pat. Nos. 28,136 and 28,166. The basic arrangement as there disclosed includes a mixing box to which a primary air supply is introduced, with one dampered opening being in communication with the ceiling plenum in which the box is located and another dampered opening being in communication with the room. Typically, the air in the ceiling plenum will be at a higher temperature than that in the room due to the heating effect of the ceiling lighting. The primary air delivered to the box is at a relatively low temperature such as 45° or 50°, and warmer air from the ceiling plenum and air from the room at room temperature may be introduced in varying proportions in accordance with positioning of the dampers for the two openings to the box. The dampers of course are arranged to work oppositely to each other so that when one damper is moving in an opening direction, the other damper is moving in a closing direction. The control of damper positioning is derived from changes in the room air temperature.

A disadvantage of the arrangement is that one or more damper motors and mechanical linkage arrangements are necessary for the prior art double induction system.

Accordingly, an aim of this invention is to avoid these disadvantages by providing a double induction mixing box devoid of dampers for controlling the proportioning of induced air from the two tempering air sources.

It is noted that control of air conditioning systems including an induction system with a fluidic arrangement is known as perhaps best exemplified by U.S. Pat. No. 3,799,246. However, the structural arrangement there shown and the device differ significantly in that the control is between one plenum in which a coil is located and another plenum which is simply a bypass.

SUMMARY OF THE INVENTION

In accordance with the invention, a double induction mixing box includes two opposite side passages, each of which has a damperless opening through which air from the room being conditioned is induced into one opening and through which air from a ceiling plenum in which the mixing box is installed is induced into the other opening in proportions to maintain a desired temperature in the room, the box being connected at its upstream end to a primary air source of sufficient capacity and velocity to effect the induction of air at the openings, and having fluidic diverting means between the upstream end of the box and the opposite side passages for controlling the diversion of the primary air between the opposite side passages to correspondingly control the induction of air into the one and the opposite side passages.

DRAWING DESCRIPTION

DESCRIPTION OF A PREFERRED EMBODIMENT

Figure 1:
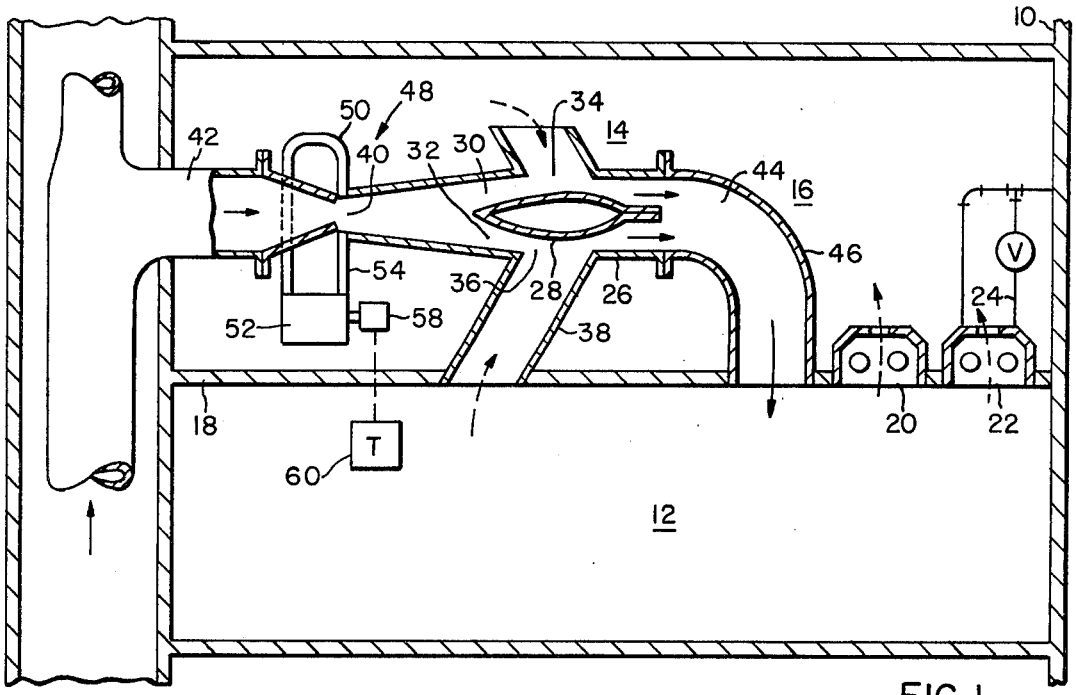
FIG. 1 is a partly broken and partly diagrammatic view of an arrangement according to the invention.

Referring to FIG. 1, a multiroom building 10 has a room 12 which is to be conditioned by the arrangement illustrated including a mixing box generally designated 14 and located in the ceiling plenum 16 overlying and separated from the room 12 by a ceiling 18. Lighting for the room is provided by luminaires 20 and 22 which are of the type which accommodate the flow of room air up through the luminaires and into the ceiling plenum from the room as indicated by the dash line arrows. The luminaire 22 is provided with an arrangement 24 for circulating cooling water through passages in the fixture to receive heat generated by the lighting fixture, as is well known in the art.

The mixing box 14 includes a housing 26 separated interiorly by the partition means 28 of generally teardrop shape which separates the interior of the box into two opposite side passages 30 and 32. The one side passage 30 is in open communication through the damperless opening 34 with the air in the ceiling plenum 16. The opposite side passage 32 is in communication through damperless opening 36 and a connecting duct 38 with the air in the room 12. The relatively narrow inlet opening or throat 40 at the upstream end of the mixing box receives high velocity, relatively cool primary air in a correspondingly narrow stream applied from a remote source through the primary air duct 42 which, at some location upstream from the inlet end of the box, includes a converging section such as shown to obtain the narrow stream. The box has an outlet 44 connected to duct 46 which delivers conditioned air to the room 12. This conditioned air comprises the primary air plus whatever air has been induced into the box through either of the two openings.

Figure 2:
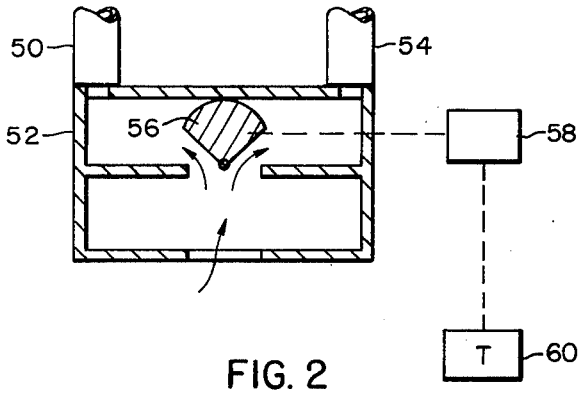
FIG. 2 is a partly broken diagrammatic view of one example of a valving arrangement of the fluidic diverter means.

To control the relative amounts of air induced through the one and the other damperless openings 34 and 36, fluidic diverter means generally designated 48 is provided. The fluidic diverter means may take any of various well known forms and the illustrated arrangement is intended to be simply exemplary. The diverting means includes a line 50 having a port at one end at the throat 40 at the upstream end of the mixing box and its other end connected to a valving device 52; and another line 54 also having a port at the opposite side of the throat and its other end also connected to the valving device 52. Referring to FIG. 2, the diagrammatically illustrated valving device 52 includes a valve 56 shown in a centered position and movable by an operator 58 which receives the operating signals from the thermostat or controller 60.

The way the system works with reference to FIG. 1 is that the primary air is diverted to the plenum side passage 30, or to the room side passage 32, or proportioned between the two passages in accordance with the pressure conditions at the control ports of the lines 50 and 54. The quantity of air induced from the plenum and from the room depends upon the flow of air past the damperless openings 34 and 36. The separating partition 28 or splitter is shaped generally as illustrated so that whatever primary air passes the damperless opening passes at a sufficiently high velocity to aspirate the room or plenum air through the respective damperless openings. As shown in FIG. 1, the upstream end of the partition or splitter is located downstream of the inlet opening 40 and upstream of the damper openings 34 and 36. With the valve of FIG. 2 in the centered position, the pressure and flow conditions at the control ports will be substantially the same on both sides and accordingly the flow will be generally equal in the two opposite side passages and substantially equal quantities of air will be induced from the plenum and from the room. It is noted that air does flow through the valving device and lines and control ports to join with the primary flow, but the volume flow rate is relatively low compared to the primary flow rate, being on the order of 1/10 of that of the primary air.

Figure 3:
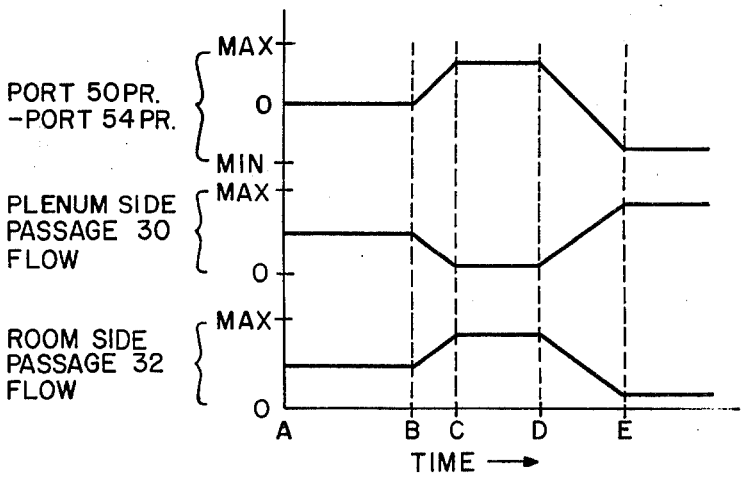
FIG. 3 is a graphical presentation illustrating the results of a modulating arrangement in which a proportional fluidic device is used to control the relative flow through both of the passages at all times.

An example follows of how the system will work with a proportioning type of control in connection with FIGS. 1, 2 and 3. With the room temperature being within the differential range which satisfies the thermostat 60, the valve 56 will be in the position shown to generally divide the air equally between the two side passages and generally induce equal amounts of air from the plenum and the room. This is the condition graphically presented between the times A and B of FIG. 3. It is then assumed that the room temperature has increased at point C above the differential range of the thermostat set point, and that a signal is sent to the operator 58 to shift the valve 56 in a direction which will increase the proportion of room air induced relative to plenum air induced. The valve 56 will rotate in a clockwise direction, as seen in FIG. 2, toward a position tending to block air flow into line 54 while increasing the flow into line 50 to is control port. Accordingly, as seen in FIG. 3, the port of line 50 pressure less the port of line 54 pressure will be an increasing positive value and as indicated at point C, the flow through the plenum side passage and correspondingly the induction thereto will decrease while the flow through the room side passage and its induction will increase. Then with a decreasing room temperature as indicated at time D-E, the thermostat through the operator 58 will shift the valve in a counterclockwise direction tending to open up the flow through line 54 to its port and blocking the flow through line 50 to its port. When this is accomplished as at time E, the pressure at port 54 will exceed that at port 50 and most of the flow will be diverted toward the plenum side passage and correspondingly will induce more air from the plenum than air induced into the room side passage from the room. The arrangement will continue to operate with the primary air being proportioned between the two opposite side passages to accomplish the desired temperature control of the room by inducing more room air when cooling is required by the thermostat and inducing more plenum air when heating is desired by the thermostat.

If the lighting arrangement includes liquid cooled luminaires 22, additional control as to plenum temperatures can be accomplished by controlling the flow of water taking heat away from the lighting fixtures. Also, the control system may be any of the well known types such as electronic, electric, or pneumatic, for example, in accordance with the particular installation. It is also noted that while the fluidic diverter means has been described in the example as using an arrangement in which air is induced into the valving device so that the control is effectively accomplished by having one control port open while the other tends toward a closed position, the control may also be accomplished by using positive differential pressure at the two control ports. Also, the diverting means can include an arrangement in which each line to a control port has an opposite open end with a motorized damper at the open end for controlling which port is blocked and which is open.

Further, the fluidic diverter means can be controlled in a way in which the primary air stream is shifted totally to one side or the other at any given time and the control is accomplished by varying the relative amounts of time that the primary air stream is totally directed toward the one passage or the opposite passage. This arrangement is considered preferable where it is desirable to use a fluidic bi-stable device to accomplish the diverting.

I claim:

1. A double induction mixing box including means separating said box into two opposite side passages, a damperless opening to each of the two opposite side passages in said box and through which air from the room being conditioned is induced into one opening, and through which air from a ceiling plenum in which said mixing box is installed is induced into the other opening, in proportions to maintain a desired temperature in the room, said box having at its upstream end a narrow inlet opening connected to a primary air source for delivering air into said inlet opening in a correspondingly narrow stream of sufficient capacity and velocity to effect said induction of air at said damperless openings, said separating means having an upstream end spaced downstream from said inlet opening and spaced upstream from said damperless openings, and fluidic diverting means located at said inlet opening where said narrow stream of primary air enters the box for controlling the diversion of primary air between the opposite side passages to correspondingly control the induction of air into the one and the opposite side passages.

2. An air conditioning device comprising:

a housing having a narrow air inlet for admitting a narrow stream of primary air at one end, an air outlet at the other end, and a main passage defined between said ends;

partition means separating said main passage into two opposite side passages from a location near the inlet end of said passage to a location adjacent the outlet end;

a damperless opening in said housing to each of the opposite sides of the passage to admit air induced by the flow of primary air past said openings from one source subject to changing temperatures to one side passage, and another source subject to having changing temperatures at rates different from the one source to said opposite side passage, the upstream end of said partition means being spaced downstream from said narrow air inlet and upstream from said damperless openings;

fluidic diverter means at said narrow air inlet for controlling the diversion of primary air between said opposite passages; and means responsive to changes in air temperature of the space conditioned by said device to control said fluidic diverter means.

3. An air conditioning system for conditioning a room having a ceiling and a plenum thereabove, comprising:

a double induction mixing box located in said ceiling plenum, said mixing box having an upstream end with a narrow primary air inlet and further having two opposite side passages separated by an interior partition, the opposite side passages being in communication at the upstream ends with a source of primary high velocity air entering said inlet in a narrow stream, and in communication at their downstream ends with an air outlet passage connected to discharge air into said room, each of said opposite side passages having a damperless opening at a location of narrowed cross section of the opposite side passages to promote the induction of air through said opening by the flow of primary air through said opposite side passages, one of said openings being in communication with the air in said plenum, and the other of said openings being in communication with the air in said room the upstream end of said interior partition being spaced downstream from said inlet and spaced upstream from said damperless openings;

lighting means in said ceiling plenum providing heat to the air in said ceiling plenum when energized;

fluidic diverter means located at said inlet of primary air to said mixing box for controlling diversion of primary air between the opposite side passages; and means responsive to changing room air temperatures to control said diverter means and thereby control the proportioning of air induced into said box from said ceiling plenum and from said room.

4. An air conditioning device comprising:

a housing having a narrow air inlet for admitting a narrow stream of primary air at one end, an air outlet at the other end, and a main passage defined between said ends, said housing having a pair of opposite walls extending in diverging relation throughout at least a portion of their lengths between said air inlet and said other end;

partition means separating said main passage into two opposite side passages from a location near the inlet end of said passage to a location adjacent the outlet end;

a damperless opening in said housing to each of the opposite sides of the passage to admit air induced by the flow of primary air past said openings from one source subject to changing temperatures to one side passage, and another source subject to having changing temperatures at rates different from the one source to said opposite side passage;

fluidic diverter means at said narrow primary air inlet for controlling the diversion of primary air between said opposite side passages with the generally narrow character of the entering narrow stream being maintained as it shifts back and forth along one and the other of the diverging opposite walls.

* * * * *